United States Patent [19]

Halliday

[11] Patent Number: 4,488,676

[45] Date of Patent: Dec. 18, 1984

[54] CONTAINER LID

[75] Inventor: Douglas S. Halliday, Whittier, Calif.

[73] Assignee: Tri-Plas Inc., Ontario, Calif.

[21] Appl. No.: 515,182

[22] Filed: Jul. 19, 1983

[51] Int. Cl.[3] ..... B65D 43/10; B65D 51/16

[52] U.S. Cl. ..... 229/43; 220/306; 220/66; 220/72; 220/74

[58] Field of Search ..... 229/43; 220/306, 66, 220/72, 74

[56] References Cited

U.S. PATENT DOCUMENTS

| | | | |
|---|---|---|---|
| 2,022,780 | 12/1935 | Peters . | |
| 2,120,905 | 6/1938 | Moore . | |
| 2,941,562 | 6/1960 | Ripin . | |
| 3,081,904 | 3/1963 | Pipes . | |
| 3,135,421 | 6/1964 | Hoffer | 220/72 |
| 3,446,385 | 5/1969 | Ponemon | 220/72 |
| 3,899,117 | 8/1975 | Peyser et al. | 229/43 |
| 3,902,599 | 9/1975 | Stromberg | 220/72 |
| 4,026,459 | 5/1977 | Blanchard | 229/43 |
| 4,252,265 | 2/1981 | Brundige et al. | 229/43 |
| 4,356,953 | 11/1982 | Rekow | 229/43 |
| 4,444,795 | 4/1984 | Weinstein | 229/43 |

*Primary Examiner*—Joseph Man-Fu Moy

*Attorney, Agent, or Firm*—Sixbey, Friedman & Leedom

[57] ABSTRACT

An auxiliary or primary lid (10) for sealing a container (12) having a rectangular cross-sectional configuration including four right angle corners is provided. The present lid includes a flat rectangular top portion (32) which corresponds to the cross-sectional configuration of the container to be closed and a continuous skirt portion (50) having four planar side portions (42, 44, 26, 48) joined perpendicularly to the perimeter of the top portion to form four right angle corners (52, 54, 56, 58). Formed in the interior surface of each planar side portion is a pair of outwardly projecting ribs (64, 66, 70, 72, 76, 78, 82, 84), each pair being separated by a discontinuity (68, 74, 80, 86) positioned in the center of each planar side portion. The ribs in adjacent planar side portions intersect at the corners of the skirt. Each corner includes, in addition, corner reinforcing means for stabilizing the corner and enhancing the gripping properties of the corner. The sealing function of the present lid has additionally been enhanced by forming adjacent ribs to have different cross-sectional configurations.

11 Claims, 6 Drawing Figures

CONTAINER LID

DESCRIPTION

1. Technical Field

The present invention relates generally to a removable lid for a container or a carton and particularly to a removable lid which can be applied to seal a container or carton having a rectangular configuration.

2. Background Art

Many food products available today are packaged in containers or cartons which are very difficult to reseal once the container has been opened. As a result, the product may deteriorate quickly once the container is opened. In particular, dried fruit, such as raisins, and cereal and crackers are packaged in such containers. These products are typically packaged in fiberboard containers which have a rectangular cross-sectional configuration and smooth exterior walls. Sealing is originally effected by gluing top flap extensions of the container sides together. Some of these containers also include paper or plastic bags inside them to provide additional packaging which is intended to maintain product quality. However, despite the provision of interior packaging, once this type of container lid is opened, resealing the original lid securely to keep the product fresh is virtually impossible.

To maintain product freshness and prolong product life after the original container has been opened, some manufacturers of packaged food products have adapted the packaging for the food in various ways. Some manufacturers, for example, provide with the container for their product an auxiliary lid which can be applied to the container to seal it and keep the contents fresh once the original container lid has been opened or removed. Such an auxiliary lid is often included with food products packaged in cans, jars, or rigid fiberboard cartons. Once the original can lid has either been removed with a can opener or has had holes punched in it, the auxiliary lid, which is typically made from a flexible plastic material, can be placed on top of the can to reseal it. Another type of removable container lid, commonly used to reseal glass jars, is applied to the container immediately after the container is filled to seal the container, but includes a separable tear strip which is removed by the consumer in opening the container. Once the strip is removed, the remainder of the lid can then be reapplied to the container to reseal it and keep the product fresh.

One of the greatest obstacles to be overcome in providing an auxiliary lid that can be used to reseal effectively a container which has had the original seal broken lies in achieving a sufficiently tight, secure seal that will keep the product as fresh as possible. Typically the auxiliary lid is made of flexible plastic material while the container it is intended to reseal is made of metal, glass or fiberboard. Metal cans usually include a slightly raised annular band around the circumference at both ends of the can where the flat top and bottom sections are joined to the cylindrical can body. Consequently, one of these annular bands can be employed to engage and retain an auxiliary lid on a can once the flat top portion of the can has either been removed or had holes punched in it. To enhance the seal achieved by the auxiliary lid, an annular lip is usually provided on the interior of the lid so that when the auxiliary lid is placed on the can, the lip is positioned to engage the annular band. Glass jars and containers have been similarly provided with annular lips or ridges for engaging lids constructed of dissimilar materials. One known type of lid used to reseal a glass jar includes a plurality of ridges spaced around the interior circumference of the plastic portion of the lid which engage a corresponding outwardly projecting annular lip on the exterior surface of the jar. However, this type of auxiliary lid and that described above for use on a metal can require that some type of outwardly projecting lip or ridge be provided on the container for the interior lid structures to engage and hold.

One known auxiliary plastic lid used to reseal a fiberboard carton once the original foil seal has been broken or removed includes an outwardly projecting ridge which extends around the perimeter of the exterior surface of the lid. The lid is then seated within the perimeter of the carton so that outwardly projecting ridge engages the upper edge of the carton.

Other primary or auxiliary container lids exemplary of the prior art are described in U.S. Pat. Nos. 2,022,780 to Peters; 2,120,905 to Moore; 2,941,562 to Ripin and 3,081,904 to Pipes. The lids disclosed in the Peters, Moore and Pipes patents all require some kind of corresponding structure associated with both the lid and the container to seal the lid on the container. Ripin discloses the provision of ribs on the interior of a container lid which do not engage corresponding structure on the exterior of a container, but which are provided to enhance sealing when both the container and the lid are formed from the same plastic material.

None of the aforementioned prior art, however, discloses providing a rectangular auxiliary lid made of a first material for sealing a rectangular container made of a second different material. The prior art discloses lid structures which are ideally suited for sealing or resealing containers having either circular configurations or essentially rectangular configurations with rounded rather than right angle corners. Ripin, in U.S. Pat. No. 2,941,562, discloses a plastic lid for a plastic container having a rectangular configuration. However, the lid disclosed by Ripin does not have a true rectangular configuration, but includes arcuate walls and is formed to cause the rectangular container walls to bow outwardly when the lid is placed on the container.

There is a need, therefore, for a removable, reusable container lid which can be employed to provide a primary or an auxiliary seal for a container having a true rectangular configuration and smooth exterior walls to maintain the freshness of the food product packaged in this type of container.

DISCLOSURE OF THE INVENTION

It is a primary object of the present invention, therefore, to provide a removable, reusable lid which can be employed to provide a primary or an auxiliary seal for a container having a true rectangular configuration and smooth exterior walls.

It is another object of the present invention to provide an auxiliary lid having a true rectangular configuration for sealing a container having a true rectangular configuration once the original lid has been removed from the container, wherein the auxiliary lid and the container are formed from different materials.

It is a further object of the present invention to provide a primary or auxiliary container lid including a rectangular top portion having a base which is longer than the height and four planar side portions connected perpendicularly to the perimeter of the top portion which intersect at right angles with each other to form a continuous skirt having formed on the interior surface thereof a series of outwardly projecting continuous ribs for effectively sealing a smooth walled, rectangular container.

It is still another object of the present invention to provide a container lid including a rectangular top portion and a perpendicularly depending rectangular skirt portion attached to the perimeter of the top portion having formed on the interior surface of the skirt a series of outwardly projecting discontinuous ribs which are continuous and intersect at the corners of the skirt portion so that the lid securely grips the corners of a rectangular container.

In accordance with the aforesaid objects, a removable, reusable lid for a container is provided having a true rectangular configuration which corresponds substantially with the configuration of the container. The lid includes a flat top portion having a rectangular shape, with the base of the rectangle being longer than the height. Attached perpendicularly to the rectangular top portion along the perimeter of the rectangle are four planar side portions which intersect at the corners of the rectangle to form a depending, continuous skirt portion having four right angle corners. A pair of ribs is formed on the interior surface of each planar side portion so that the ribs of one said portion intersect at the corners with the ribs of the two adjacent side portions and each pair of ribs is separated by a disctoninuity which is positioned in the center of each side portion. The ribs parallel to the base of the rectangle formed on the top portion have a different cross-sectional configuration from the ribs parallel to the height of the rectangle formed by the top portion. This difference in cross-sectional configuration results in an especially rigid and stable corner junction where the ribs intersect and permits the lid to grip tightly a rectangular fiberboard container having four right angle corners and smooth exterior walls.

BEST MODE FOR CARRYING OUT THE INVENTION

The configuration of the lid of the present invention permits it to fit snugly and securely on a container or carton which has a rectangular cross-sectional configuration and vertical side walls having a smooth exterior surface. The type of carton for which the present lid is ideally suited is preferably made from fiberboard, wax coated cardboard or a similar material. The primary lid for this type of container is typically formed by gluing a plurality of interfolded flaps which are extensions of the sides of the container. During opening these flaps are usually torn. However, even if they are not torn, once this type of container is opened, it is extremely difficult to reseal it with the original flaps. The auxiliary lid of the present invention may be quickly and easily applied to effectively seal and reseal this type of container, thereby maintaining product freshness impossible to achieve with the original lid.

Figure 1:
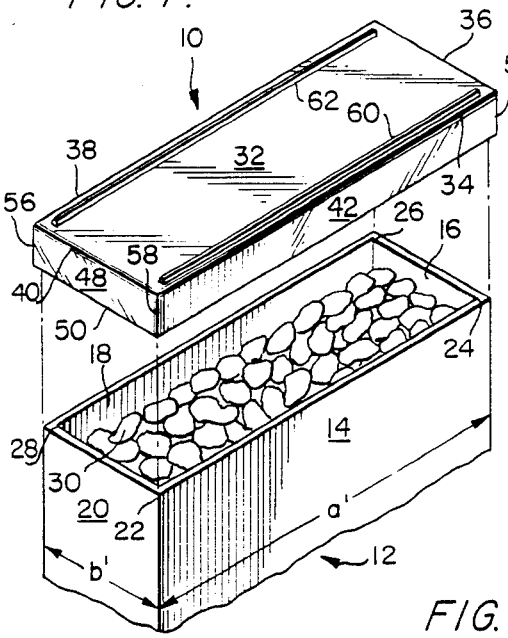
FIG. 1 is an exploded perspective view of a container holding a food product and the lid of the present invention positioned above the container.
Figure 2:
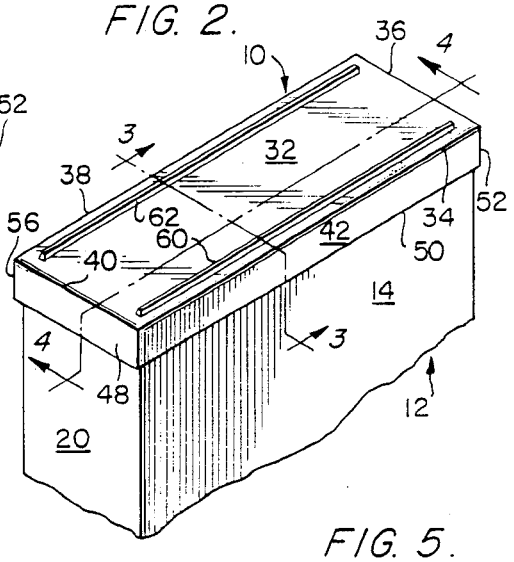
FIG. 2 is a perspective view showing the lid of the present invention in place on a container.

Referring to the drawings, FIGS. 1 and 2 show the lid 10 of the present invention as it would appear positioned both above and fitted to the top of a container 12. The container 12 on which the lid 10 is most effectively employed has the cross-sectional configuration of a true rectangle. This type of container has four sides, 14, 16, 18 and 20, which intersect to form four right angle corners, 22, 24, 26 and 28. In the container shown in FIGS. 1 and 2, the rectangle formed by the intersection of the four sides has a base (sides 14 and 18) which is substantially larger than the height (sides 16 and 20). Each of the sides 14, 16, 18 and 20 of the container 12 has a smooth exterior surface. The food product inside the container 12 is shown at 30.

The lid 10 has a rectangular configuration which corresponds substantially to that of the container to permit the lid to be seated securely on the container in a manner which will be more fully described hereinbelow. The lid 10 includes a rectangular top portion 32, which has a base, sides 34 and 38, which is longer than the height of the rectangle, sides 36 and 40. Joined perpendicularly to the lid top portion 32 are four rectangular planar side portions 42, 44, 46 and 48, of which only side portions 42 and 48 are shown in FIGS. 1 and 2. The base of rectangular planar side portions 42 and 46 corresponds to the base of rectangular top portion 32, and the base of rectangular planar side portions 44 and 48 corresponds to the height of rectangular top portion 32. These four planar side portions form a junction with top portion 32 around its perimeter. Planar side portion 42 is joined along one edge to side 34, planar side portion 44 is joined to side 36, planar side portion 46 is joined to side 38, and planar side portion 48 is joined to side 40, respectively, to form a continuous skirt 50 which extends away from the lid top portion 32. Planar side portion 42 intersects with one end of planar side portions 44 and 48 to form skirt corners 52 and 58, respectively, and planar side portion 46 intersects with the opposite end of planar side portions 44 and 48 to form skirt corners 54 and 56, respectively.

The exterior surface of top portion 32 has been provided with a pair of opposed, parallel ridges 60 and 62. Ridge 60 extends parallel to and substantially along the full length of top portion side 34, and ridge 62 extends parallel to and substantially along the full length of top portion side 38. Ridges 60 and 62 are positioned slightly away from sides 34 and 38, respectively, and toward the center of top portion 32. The function of ridges 60 and 62 is to permit a large number of lids 10 to be stored easily in a stacked condition, one lid on top of another, while simultaneously preventing nesting or sticking together of adjacent lids. This feature also facilitates the application of the lids to containers with automated equipment.

Figure 3:
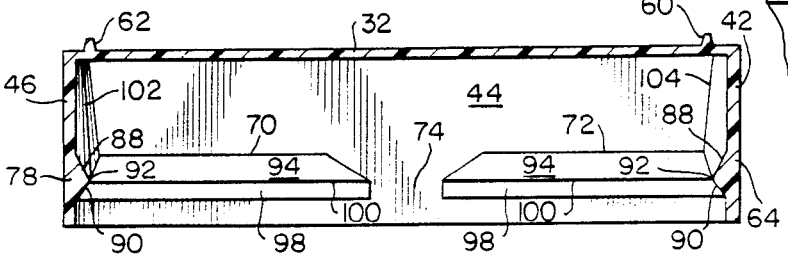
FIG. 3 is a cross-sectional view of the container lid taken along lines 3—3 of FIG. 2.
Figure 5:
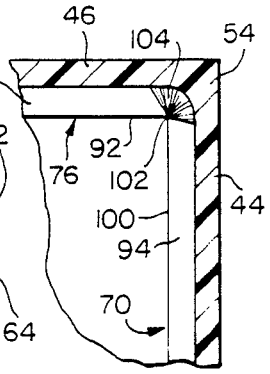
FIG. 5 is a cross-sectional view of the container lid taken along lines 5—5 of FIG. 4.
Figure 4:
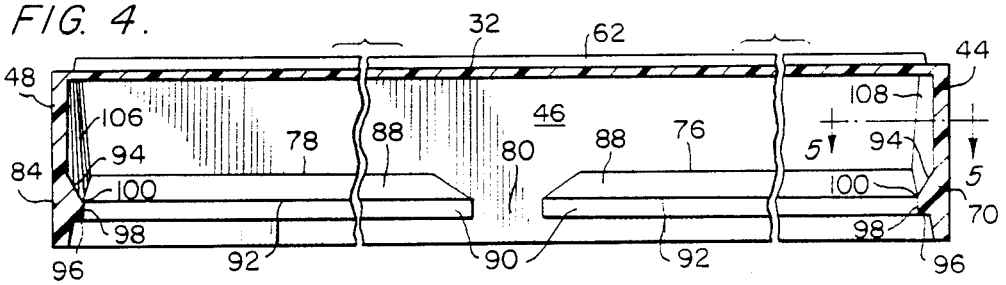
FIG. 4 is a cross-sectional view of the container lid taken along lines 4—4 of FIG. 2.
Figure 6:
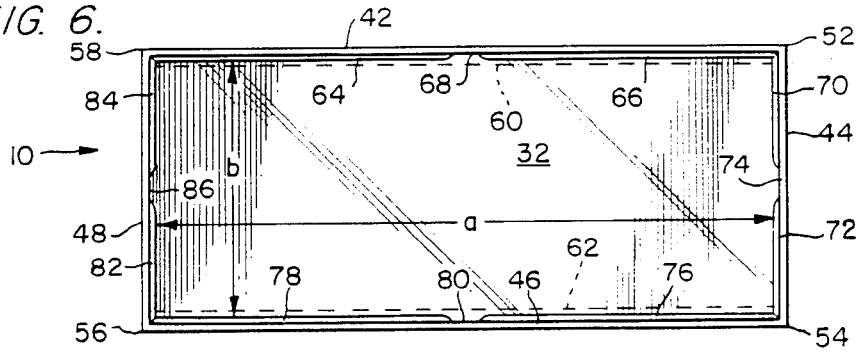
FIG. 6 is a view of the inside of the lid of the present invention.

FIGS. 3, 4 and 5 illustrate features of the present lid which permit its enhanced sealing capabilities. The interior surface of skirt 50 is provided with a series of discontinuous ribs along the perimeter of skirt 50 which project outwardly from the interior skirt surface toward the center of top portion 32. Each planar side portion 42, 44, 46 and 48 includes a pair of ribs separated by a discontinuity which preferably corresponds to approximately the center of each planar side portion. The preferred positioning of the ribs is shown in FIG. 6. Discontinuous ribs 64 and 66, separated by discontinuity of space 68, are formed in planar side portion 42, and ribs 70 and 72, separated by space 74 are formed in planar side portion 44. Planar side portion 46 includes ribs 76 and 78 separated by space 80, and planar side portion 48 includes ribs 82 and 84 separated by space 86. Adjacent ribs intersect at each corner 52, 54, 56 and 58, of the skirt 50 as shown in FIG. 6 to form an especially strong corner structure which tightly grips the corners of the container when the lid is applied. The ribs project outwardly from the interior surface of skirt 50 a sufficient distance so that the distance a between the ribs in planar side portions 44 and 48 is approximately equal to the distance a', which corresponds to the dimension of the base of the rectangle forming the cross-sectional configuration of container 12. In addition, the distance b between the ribs in planar side portions 42 and 46 is approximately equal to the distance b', which corresponds to the dimension of the height of the rectangle forming the cross-sectional configuration of container 12.

The ribs formed in planar side portions 42 and 46 have a slightly different cross-sectional configuration than that of the ribs formed in plural side portions 44 and 48. FIG. 3 shows the cross-sectional configuration of the ribs 64 and 70 formed in planar side portions 42 and 46, respectively. Although not shown, the cross-sectional configuration of rib 66 is identical to that of rib 64, and the cross-sectional configuration of rib 76 is identical to that of rib 78. These ribs include a top extension section 88, which forms an angle substantially greater than 90° with the interior surface of each planar side portion in which it is formed. Each of these ribs additionally includes a bottom extension section 90, which forms an angle with the interior surface of each planar side portion in which it is formed which is smaller than that formed by top extension section 88. Top extension section 88 and bottom extension section 90 intersect to form the outermost extent 92 of the rib.

FIG. 4 illustrates the cross-sectional configuration of the ribs 70 and 84 formed in planar side portions 44 and 48, respectively. Although not specifically illustrated, the cross-sectional configuration of rib 72 is identical to that of rib 70, and the cross-sectional configuration of rib 82 is identical to that of rib 84. These ribs include a top extension section 94 which forms an angle substantially greater than 90° with the interior surface of the planar side portion, a first bottom extension section 96, which forms an angle smaller than that formed by top extension section 94 with the interior surface of the planar side portion, and a second bottom extension section 98. The second bottom extension section 98 forms a 90° angle with the first bottom extension section and intersects with the top extension section 94 to form the outermost extent 100 of the rib. The distance from the exterior surface of each planar side portion to the outermost extent 100 of the ribs in planar side portions 44 and 48 is greater than the distance from the exterior surface of each planar side portion to the outermost extent 92 of the ribs in planar side portions 42 and 46.

FIG. 5 illustrates in cross-section the corner structure of the present container lid and, in particular, the corner formed by the intersection of planar side portions 44 and 46. The outermost extents 92 and 100 of ribs 76 and 70 intersect to form a right angle at point 102, which contributes to the stability of the right angle corner 54.

The stability and gripping properties of the corner structure are further enhanced by the provision of a corner reinforcement 104, shown in cross-section in FIG. 5, which is fitted into corner 54 and extends from the point of intersection of the two adjacent ribs 70 and 76 to the interior surface of lid top portion 32. The remaining corners all include corner reinforcements, designated by reference numbers 104, 106 and 108, which are identical to the one shown in FIG. 5. The precise positioning of these corner reinforcments with respect to the ribs and the top portion 32 can be more clearly seen in FIGS. 3 and 4.

The ribs formed in each planar side piece do not extend in a continuous line around the interior perimeter of skirt 50, but are separated by central discontinuities which can be clearly seen in FIG. 6. The terminal edge of each rib adjacent the central discontinuity does not end abruptly, but preferably terminates gradually with a smooth chamfer or bevel as shown in FIGS. 3 and 4.

The lid of the present invention is preferably formed from a relatively lightweight plastic using conventional injection molding techniques. The material selected should be sufficiently flexible to permit easy manipulation of the lid in applying it to and removing it from a container, but should also be sufficiently rigid to permit it to be handled in automated equipment and easily stored. Additional rigidity is, of course, imparted to the corners and skirt of the lid by the intersecting ribs and corner reinforcements discussed above.

INDUSTRIAL APPLICABILITY

The present container lid will find its primary application on rectangular, smooth sided fiberboard food containers and cartons such as those in which dried fruit, cereal and crackers are typically packaged. The present lid can be easily applied, removed and reapplied to seal the container and keep the package contents fresh. However, the use of the present lid will not necessarily be restricted to the sealing of food containers, but can be employed as a closure for any type of container having a true rectangular configuration and smooth exterior side walls.

I claim:

1. Closure means for sealing a container with a rectangular cross-sectional configuration having four parallel sides which intersect to form four right angles and smooth exterior side walls, said closure means comprising a flat top portion corresponding substantially to the rectangular cross-sectional configuration of the container, a continuous skirt portion joined perpendicularly to the perimeter of the top portion which extends away from said top portion, said skirt portion including four planar side portions corresponding in length to the sides of the rectangular top portion which intersect to form four right angle corners, each of said planar side portions having formed therein a pair of ribs projecting outwardly from said planar side portions, each of said pair of ribs being separated by a discontinuity positioned in approximately the center of each planar side portion and each one of said pair of ribs intersecting at said corners with a rib in an adjacent planar side portion, each of said corners formed by the intersection of said planar side portions including corner reinforcing means for providing stability to said corners and causing said closure means to grip the corners of said rectangular container securely when said closure means is applied to said container.

2. Closure means as described in claim 1, wherein each of said planar side portions has a rectangular configuration, and the two of said planar side portions which are opposite each other have the same dimensions, the base of two opposed planar side portions corresponding to the base of the rectangle formed by said flat top portion and the base of the remaining two opposed planar side portions corresponding to the height of the rectangle formed by said flat top portion to form two long planar side portions and two short planar side portions.

3. Closure means as described in claim 2, wherein the cross-sectional configuration of said ribs formed in said long planar side portions is different from the cross-sectional configureation of said ribs formed in said short planar side portion.

4. Closure means as described in claim 3, wherein each of said corner reinforcing means is positioned in each of the corners formed by said intersecting planar side portions to extend from the intersection of the ribs in adjacent planar side portions to said flat top portion.

5. Closure means as described in claim 4, wherein said flat top portion includes formed in the upper surface thereof a pair of opposed parallel ridges, said ridges being positioned parallel to the base of the rectangle formed by said top portion and spaced apart a distance which is less than the height of said rectangle.

6. Closure means as described in claim 5, wherein the portion of each rib adjacent each discontinuity terminates in a smooth chamfer.

7. Closure means as described in claim 2 wherein each of the ribs formed in said long planar side portions includes a top extension section which intersects with said planar side portion to form an angle greater than 90°, and a bottom extension section which intersects with said planar side portion to form an angle smaller than that formed by said top extension section and said planar side portion, said top extension section and said bottom extension section intersecting to form the outermost extent of each of said ribs.

8. Closure means as described in claim 7, wherein each of the ribs formed in said short planar side portions includes a top extension section which intersects with said planar side portion to form an angle of greater than 90°, a first bottom extension section which intersects with said planar side portion to form an angle smaller than that formed by said top extension section and said planar side portion, and a second bottom extension section which intersects with said first bottom extension section to form a 90° angle, said top extension section and said bottom extension section intersecting to form the outermost extent of each of said ribs.

9. Closure means as described in claim 8, wherein the distance between the outermost extent of the ribs formed in said opposed long planar side portions is equal to one dimension of the rectangular cross-section of the container and the distance between the outermost extent of the ribs formed in said opposed short planar side portions is equal to the other dimension of the rectangular cross-section of the container.

10. Closure means as described in claim 9, wherein the rectangle formed by said flat top portion has a base which is substantially longer than the height.

11. Closure means as described in claim 9, wherein the rectangle formed by said flat top portion has a base which is equal to the height.

* * * * *